United States Patent [19]

Buchter

[11] Patent Number: 4,949,946

[45] Date of Patent: Aug. 21, 1990

[54] QUICK-ACTING CLAMPING DEVICE

[75] Inventor: Beat Buchter, Hallau, Switzerland

[73] Assignee: Buchter Formenbau AG, Switzerland

[21] Appl. No.: 387,522

[22] Filed: Jul. 31, 1989

[30] Foreign Application Priority Data

Aug. 11, 1988 [CH] Switzerland ..... 3036/88

[51] Int. Cl.[5] ..... B25B 1/08

[52] U.S. Cl. ..... 269/203; 269/235

[58] Field of Search ..... 269/235, 233, 236, 203, 269/205, 99, 196, 231

[56] References Cited

U.S. PATENT DOCUMENTS

| | | | |
|---|---|---|---|
| 307,439 | 11/1884 | Corbett | 269/203 |
| 4,101,119 | 7/1978 | Speiser et al. | 269/203 |
| 4,805,888 | 2/1989 | Bishop | 269/235 |

*Primary Examiner*—Robert C. Watson

*Attorney, Agent, or Firm*—Ralph W. Selitto, Jr.

[57] ABSTRACT

The quick-acting clamping device for clamping preferably identically shaped workpieces has a base part (1) comprising an elongate yoke plate (2) and a fixed jaw (3) at each of the end faces. Into a longitudinally oriented guide slot (6) in the base part (1) is inserted a clamping block (7) which is longitudinally displaceable between the jaws (3), can be locked on the base part (1) at any desired point in the displacement range by means of a set screw (36) and has a side part on which a clamping head (8), held by means of a connecting link guide, is longitudinally displaceably mounted. The clamping head (8) can be moved in the clamping direction (C) towards a jaw (3) by means of an excentric part (22) rotatably mounted in the slide part in order to hold the workpiece.

3 Claims, 3 Drawing Sheets

A
B
V

QUICK-ACTING CLAMPING DEVICE

The present invention relates to a quick-acting clamping device in accordance with the preamble of patent claim 1, for clamping preferably identically shaped workpieces during their machining.

Quick-acting clamping devices for clamping workpieces are known in a multiplicity of embodiments. There are clamping devices operating with toggle lever arrangements, in which the workpiece is forced into the fixing position against a receiving device by a pressure member on the shorter arm of the lever arrangement. Clamping shoe devices are also known which are provided with screw or spindle clamping elements for generating the contact pressure. There are furthermore excentric clamping devices on the market in which the excentric acts either directly or via a pressure member on the workpiece and ensures that it is held stably.

Where such quick-acting clamping devices are not set up for particular workpiece shapes or workpiece types and can thus be equated with special tools, their clamping or gripping system is generally designed such that a distinction has to be made according to clamping criteria, e.g. round or block clamping faces on the workpiece, in order to determine the most suitable type of device for a specified machining task.

The object of the present invention is to create a quick-acting clamping device which is designed in accordance with the principle of the jaw vice with a short clamping distance and preselectable clamping range and has a clamping block which can brought into a fixed starting position relative to one or two fixed jaws. It should be possible to bring this clamping block out of the said starting position by means of a simple actuating member into a clamping position against a workpiece. It should be possible to assemble a plurality of such quick-acting clamping devices into groups and use them as a multiple tool for the simultaneous or successive machining of identical or different workpieces.

The solution according to the invention of these objects is defined by the defining features of patent claims 1. Embodiments thereof emerge from the dependent claims.

It is advantageous that the clamping block, which is provided with an excentric part and can be brought into and out of clamping engagement with one of the fixed jaws, can be fixed at any desired point of its adjustment range by means of a simple fixing means and that furthermore the clamping jaw can be brought by a short actuating movement into a reproducible withdrawn position in which the workpiece can easily be inserted into and removed again from the clamping device.

An exemplary embodiment of the invention is described below with reference to a drawing, in which.

Figures 2, 4A, 4B:
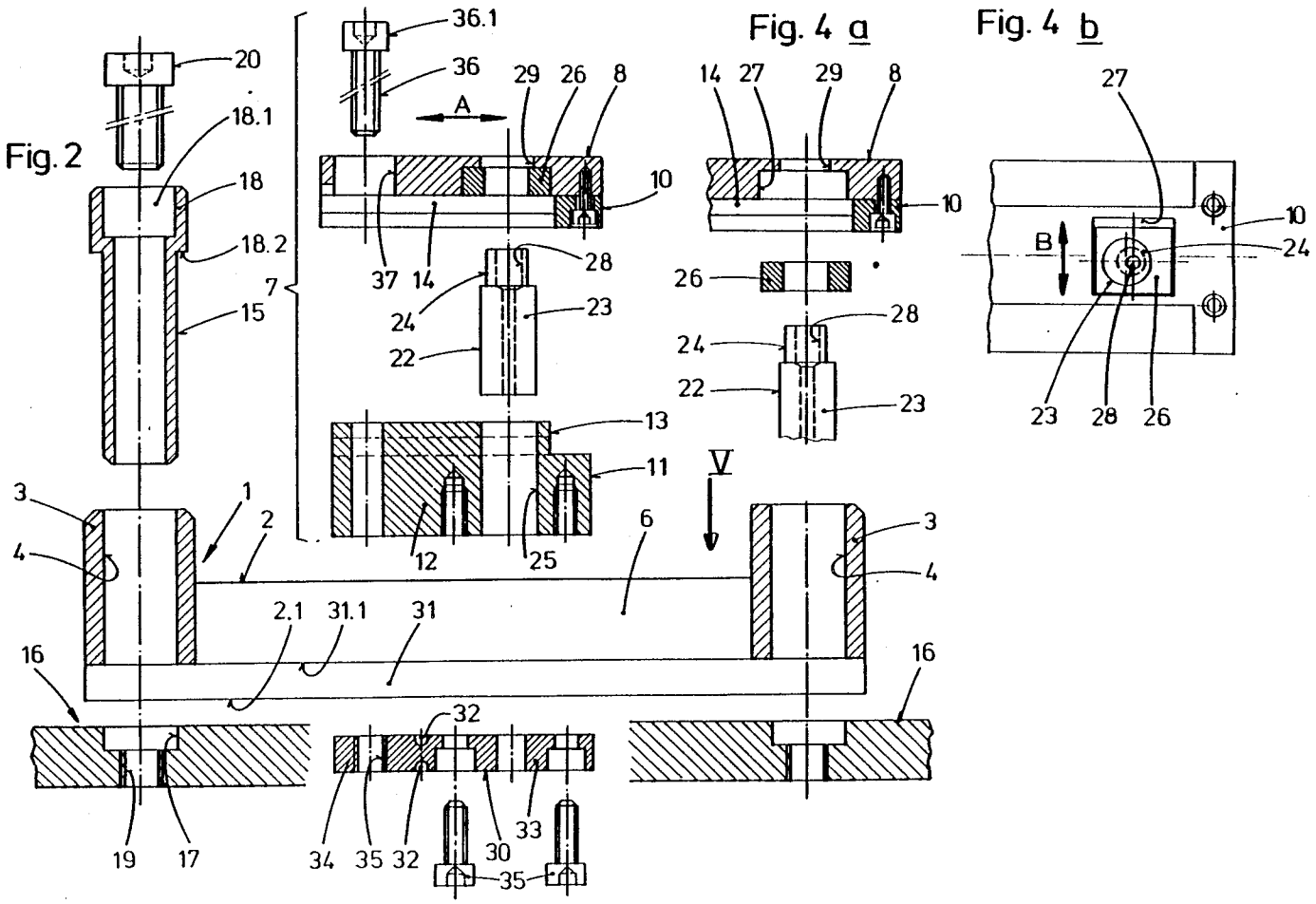
FIG. 2 shows an exploded representation of the clamping unit according to FIG. 1 in longitudinal section and according to line II—II in FIG. 1.

FIGS. 4*a* and 4*b* show the detail of the excentric mounting in the (movable) clamping jaw represented in the manner of FIG. 2 and in the view from below (b).

Figure 1:
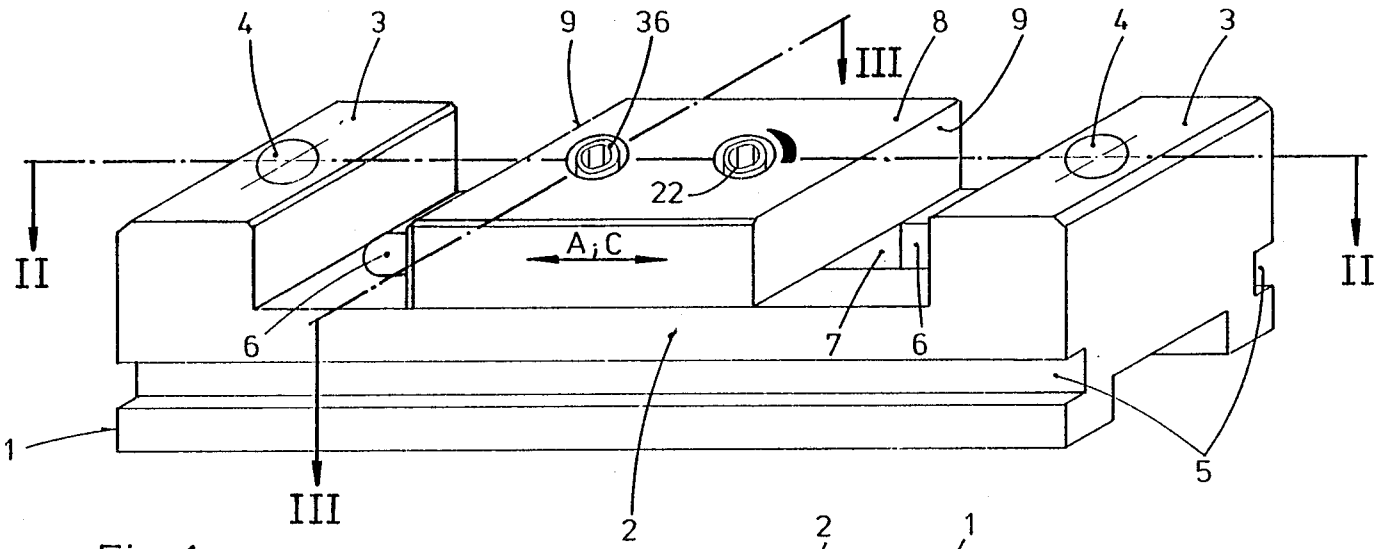
FIG. 1 shows a quick-acting clamping device as clamping unit for workpieces having parallel clamping faces, in perspective representation.
Figure 5:
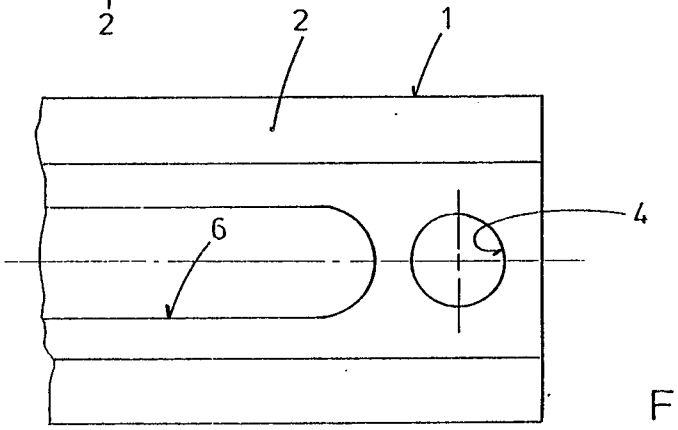
Figure 6:
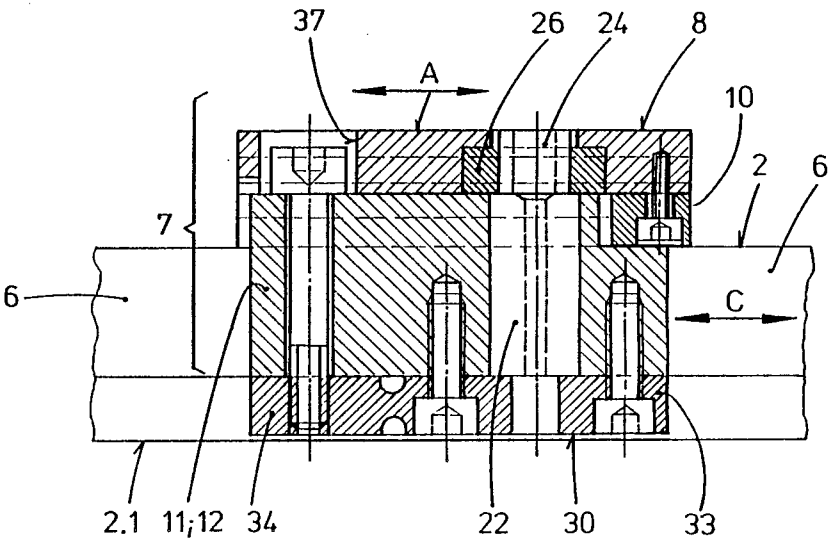
Figure 3:
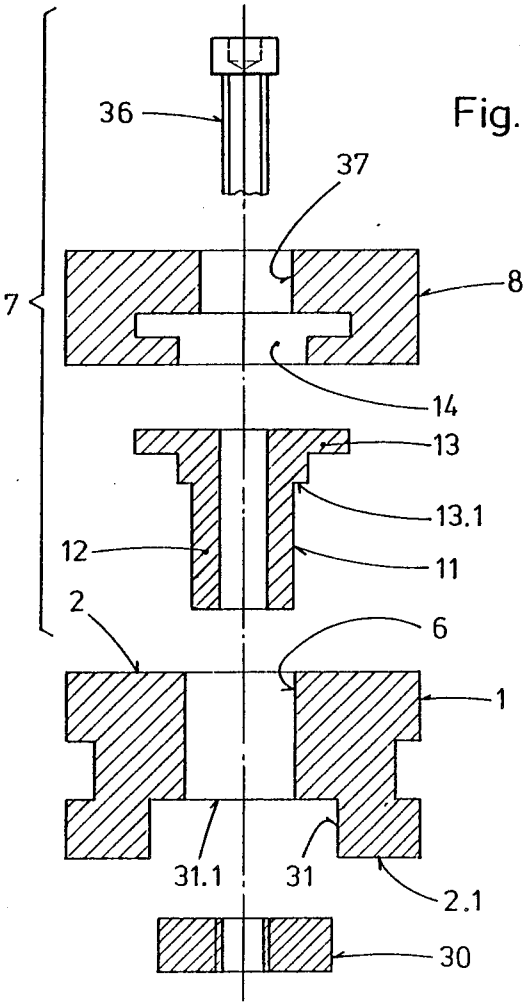
FIG. 3 shows an exploded representation of the clamping unit in accordance with line III—III in FIG. 1.

FIG. 5 shows a partial plan view representation of the base part of the quick-acting clamping device in arrow direction V in FIG. 2, and FIG. 6 shows the clamping block mounted in the base part of the clamping unit according to FIG. 1, in partial longitudinal section in accordance with the line II—II in FIG. 1.

According to FIG. 1, the quick-acting clamping device comprises a base part 1 having two fixed jaws 3 which are mounted, preferably integrally, on a yoke plate 2 and which are in each case provided with a mounting bore 4 explained later on in the text. The yoke plate 2 contains laterally open clamping grooves 5 for clamping the base part 1 on any bed plate or a machine table, and a guide slot 6 running longitudinally through the center for accommodating a clamping block 7 in such a way that it can be displaced longitudinally, of which clamping block essentially only the clamping head 8 can be seen. Of the front end faces 9 of the clamping head 8 at least one is designed as clamping surface. The clamping block 7 is described in detail below with reference to FIG. 2 and FIGS. 4*a, b.*

Over the base part 1 in the exploded representations according to FIGS. 2, 3, 4*a* and 4*b* can be seen the clamping block, designated overall by 7, comprising a slide part 11 having a guide plate 12 at the bottom and a T-fitting piece 13 of a connecting link guide. Above the T-fitting piece 13 is shown the clamping head 8 which contains the counterpart of the said connecting link guide in the form of a T-slot 14 which is matched to the T-fitting piece 13 and, in the assembled condition of the clamping block 7 (FIG. 6), accommodates this T-fitting piece longitudinally displaceably and essentially free of play. On the excentric side, the T-slot 14 in the clamping head 8 is of closed design and, in order to facilitate or permit the machining of the slot, is expediently closed by a strip 10 attached by screw fastening. In the installed condition of the clamping block 7, the guide plate 12 is mounted with a sliding fit in the guide slot 6 in order to ensure an exact longitudinal movement of the clamping block 7 in the base part 1.

A fitting member in the form of a fitting sleeve 15 is furthermore shown in FIG. 2 above the base part 1, the shaft of which fitting member or sleeve is intended to pass through the mounting bore 4 in the fixed jaws 3 in order to center and secure a single or a plurality of clamping units on an individually configurable bed plate 16 (shown diagrammatically) and the lower end of which engages in a centering seat 17 of this bed plate. The fitting sleeve 15 has a head portion 18 widened in diameter, having a head opening 18.1 which permits it to accommodate the head of a hexagon socket head screw 20. The head shoulder 18.2 comes to rest on the upper side of the jaw 3. The clamping unit is secured on the base plate 16 by means of the hexagon socket head screws 20, which engage in threaded bores 19 of the bed plate 16, pass through the sleeve bore 21 with sufficient play and the heads of which are sunk in the head portion 18 of the fitting sleeve.

The movement of the clamping head 8 longitudinally displaceable relative to the slide part 11 (arrows A in FIGS. 1, 2 and 6) is controlled by an excentric part 22 which, as also shown in FIG. 4*a*, comprises a guide cylinder 23 (situated at the bottom) and an excentric cam 24 preferably formed integrally on the end face of the latter. The guide cylinder 23 of the excentric part 22 is rotatably mounted, essentially without play, in a vertical bore 25 of the slide part 11 and extends virtually over its entire length inside the slide part. The excentric cam 24 having an excentricity of 0.5–2 mm, depending on the desired clamping force and the clamping travel provided, engages in an excentric nut 26 (FIG. 4*b*) which is mounted so as to be transversely displaceable (arrow B) and captive in a rectangular recess 27 above the T-slot 14 in the clamping head 8. The excentric part 22 is provided on its upper side with a polygonal recess 28, e.g. a hexagonal hole, for receiving an Allen key which can be inserted as actuating tool for the excentric part 22 via an opening 29 in the surface of the clamping head 8.

In the mounted condition of the clamping block 7, in which, by means of the T-slot 14 and the T-fitting piece 13, the clamping head 8 is in sliding relationship with the plate 12, the excentric part 22 is in the vertical bore 25 of the slide part 11 and the excentric cam 24 is in engagement with the excentric nut 26, the guide plate 12, as can be seen from FIG. 6, engages through the guide slot 6 present in the longitudinal center of the yoke plate 2. In this position, the clamping block 7 is held by means of a slide plate 30 which is shown under the base part 1 in the exploded representations in FIGS. 2 and 3. This slide plate 30 is sunk in a groove 31 on the underside of the yoke plate 2 in such a way that all its parts are set back relative to the yoke-plate bottom view 2.1. The slide plate 30 contains two longitudinal portions divided by transverse-running weakening grooves 32, namely a mounting portion 33 on which the slide plate 30 is screwed to the bottom view of the guide plate 12 by means of two hexagon socket head screws 35 in such a way that the clamping block 7 can be displaced essentially without play between the fixed jaws 3 on the base part. The second longitudinal portion of the slide plate 30 is a clamping portion 34, which is provided with a threaded bore 35 for accommodating a hexagon socket head screw 36 whose head 36.1 can be tightened with sufficient play for the clamping movement (arrow A) of the clamping head 8, through the recess 37 of the latter, against the upper side of the T-fitting piece 13 on the slide part 11. During this procedure, the clamping portion 34 is tightened against the base 31.1 of the groove 31 and the base shoulder 13.1 of the T-fitting piece 13 is tightened against the upper side 2.2 of the yoke plate 2. During this procedure, the clamping portion 34 of the slide plate 30 is elastically deformed and the clamping block 7 rigidly connected to the base part 1. The clamping block 7 rigidly connected to the base part 1. The clamping head 8 remains longitudinally movable under the control of the excentric part 22.

Following the release of the hexagon socket head screw 36, the clamping block 7 or the clamping head 8 can be brought to any desired positions (arrows C in FIGS. 1 and 6) between the jaws 3, in particular to the insertion and removal positions of workpieces, and fixed there. By actuating the excentric part 22 using a socket tool, the clamping of the workpiece is then brought about and cancelled again.

I claim:

1. A quick-acting clamping device for clamping workpieces, comprising a base part having an elongated yoke plate and a fixed jaw at each end of said yoke plate, said yoke plate having a guide slot therethrough and having a lower abutment surface, said guide slot being longitudinally arranged between said fixed jaws; and a clamping block on said base part, said clamping block having a clamping head and a slide part which is longitudinally movable relative to said base part, whereby said clamping block is longitudinally displaceable and lockable at any selected point between said fixed jaws, said slide part including a guide plate which is longitudinally movable in said guide slot, said guide plate having a top on which there is integrally formed a first part of a connecting link guide and having a bottom which is connected to a slide plate, said first part having a base shoulder which cooperates with said slide plate to maintain said guide plate in said guide slot, said slide plate having a mounting portion and a clamping portion, said mounting portion and said clamping portion being longitudinally arranged and divided by transversely running weakening grooves, said mounting portion attaching firmly to said bottom of said guide plate and said clamping portion being elastically clampable against said first part and said abutment surface, whereby said clamping block is alternatively clampable against said yoke plate and longitudinally displaceable relative thereto, and said clamping head including a second part of said connecting link guide, wherein said second part slideably engages with said first part such that said clamping head is longitudinally displaceable on said slide part, and a rotatably mounted eccentric part, wherein said clamping head is moveable in a clamping direction on said slide part.

2. A quick-acting clamping device as claimed in claim 1, wherein the connecting link guide is a T-slot and key pair comprising said guide plate top and said clamping head, said guide plate top including a T-fitting piece and said clamping head including said T-slot wherein said base shoulder of said T-fitting piece is supported on an upper side of said yoke plate.

3. A quick-acting clamping device as claimed in claim 1, wherein said eccentric part comprises a guide cylinder rotatably mounted in a bore of said slide part and having an end face and an eccentric cam formed integrally in the axial direction on said end face of said guide cylinder.

* * * * *